US009610630B2

(12) United States Patent
Shigihara et al.

(10) Patent No.: US 9,610,630 B2
(45) Date of Patent: Apr. 4, 2017

(54) CLOSED-DIE FORGING METHOD AND METHOD OF MANUFACTURING FORGED ARTICLE

(75) Inventors: Yusuke Shigihara, Yasugi (JP); Koji Sato, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 17 days.

(21) Appl. No.: 13/997,875

(22) PCT Filed: Dec. 26, 2011

(86) PCT No.: PCT/JP2011/079988
§ 371 (c)(1),
(2), (4) Date: Jun. 25, 2013

(87) PCT Pub. No.: WO2012/090892
PCT Pub. Date: Jul. 5, 2012

(65) Prior Publication Data

US 2014/0144199 A1 May 29, 2014

(30) Foreign Application Priority Data

Dec. 28, 2010 (JP) ..... 2010-292505

(51) Int. Cl.
*B21J 5/02* (2006.01)
*B21J 1/06* (2006.01)
(Continued)

(52) U.S. Cl.
CPC ..... *B21J 5/025* (2013.01); *B21J 1/06* (2013.01); *B21K 1/32* (2013.01); *B21J 3/00* (2013.01)

(58) Field of Classification Search
CPC ..... B21J 5/02; B21J 1/02; B21J 3/00; B21J 5/025; B21J 5/06; B21K 1/32
(Continued)

(56) References Cited

U.S. PATENT DOCUMENTS 2,960,763 A * 11/1960 Reichl ..... B21J 5/00 29/423
4,269,053 A * 5/1981 Agrawal et al. ..... 72/42
(Continued)

FOREIGN PATENT DOCUMENTS

CN 101147950 A 3/2008
CN 101412066 A 4/2009
(Continued)

OTHER PUBLICATIONS

Communication dated Aug. 5, 2014, issued by the State Intellectual Property Office of the People's Republic of China in application No. 201180063574.8.

*Primary Examiner* — Jimmy T Nguyen
*Assistant Examiner* — Gregory Swiatocha
(74) *Attorney, Agent, or Firm* — Sughrue Mion, PLLC

(57) ABSTRACT

Provided are: a closed-die forging method capable of preventing a temperature decrease in a to-be-forged member during forging, easy temperature monitoring during forging, and filling the cavity end portions of a die with the to-be-forged member; and a method of manufacturing a forged article using the closed-die forging method. The closed-die forging method includes covering a surface of the to-be-forged member (preferably a super-alloy) that contacts the lower die with a metal heat-insulation member (preferably stainless steel) prior to forging, except for at least a part of the surface that contacts an upper die during forging, placing the heated to-be-forged member on a lower die, and hammer-forging the to-be-forged member integrally with the metal heat-insulation member. A forged article is prepared by heat-treating the forged article obtained by the closed-die forging method (preferably in a disk shape) at temperatures not lower than the recrystallization temperature of the forged article.

11 Claims, 4 Drawing Sheets

(51) Int. Cl.
*B21J 3/00* (2006.01)
*B21K 1/32* (2006.01)

(58) Field of Classification Search
USPC ..... 72/47, 342.94, 352, 357, 360, 363, 42; 148/675
See application file for complete search history.

(56) References Cited

U.S. PATENT DOCUMENTS

| | | | | | |
|---|---|---|---|---|---|
| 5,269,857 | A | * | 12/1993 | Ganesh et al. | 148/675 |
| 5,374,323 | A | * | 12/1994 | Kuhlman et al. | 148/677 |
| 5,547,632 | A | * | 8/1996 | Horimura et al. | 419/28 |
| 6,330,818 | B1 | * | 12/2001 | Jain | 72/42 |
| 2011/0302979 | A1 | * | 12/2011 | Oppenheimer et al. | 72/42 |

FOREIGN PATENT DOCUMENTS

| | | | | |
|---|---|---|---|---|
| GB | 1202080 | A | * | 8/1970 |
| JP | 62-286636 | A | | 12/1987 |
| JP | 5-177289 | A | | 7/1993 |
| JP | 6-122036 | A | | 5/1994 |
| JP | 07-179909 | A | | 7/1995 |
| JP | 2000-051987 | A | | 2/2000 |

* cited by examiner

EXAMPLE 1 OF THE PRESENT INVENTION (WITH COVER)

COMPARATIVE EXAMPLE 1 (WITHOUT COVER)

PORTION A PORTION B PORTION C 100 μm

EXAMPLE 2 OF THE PRESENT INVENTION (WITH COVER)

PORTION A PORTION B PORTION C 100 μm

EXAMPLE 3 OF THE PRESENT INVENTION (WITH COVER)

CLOSED-DIE FORGING METHOD AND METHOD OF MANUFACTURING FORGED ARTICLE

CROSS REFERENCE TO RELATED APPLICATIONS

This application is a National Stage of Application No. PCT/JP2011/079988 filed Dec. 26, 2011 (claiming priority based on Japanese Patent Application No. 2010-292505 filed Dec. 28, 2010), the contents of which are incorporated herein by reference in their entirety.

TECHNICAL FIELD

The present invention relates to a closed-die forging method for metallic materials like various types of alloys and steel, and particularly for a superalloy material which is used for airplane components and generator components such as a turbine disk and a blade. The present invention also relates to a method of manufacturing a forged article by utilizing this closed-die forging method.

BACKGROUND ART

Closed-die forging is a technique which can improve mechanical characteristics by crystal grain refining due to forging and the like and can reduce the number of subsequent machining steps, because a member to be forged which has been heated to a forging temperature is forged into a shape close to a final product. Accordingly, the closed-die forging is a technique useful for manufacturing a structural component which is required to have a high-temperature strength in a form of a near net shape, and is often used in manufacturing of a component formed from a superalloy material, for instance, such as a turbine disk of an airplane. However, when the temperature of the member to be forged is decreased during forging, elongation is locally reduced and a crack occurs on the surface of a base material after forging. This occurrence of the surface crack has been a problem particularly in the forging of the superalloy which is a hard-to-work material.

An isothermal forging method of heating a die during forging and a technique of sequentially heating a member to be forged are proposed as a technique for solving the above described problem (Patent Literature 1). However, the technique in Patent Literature 1 is disadvantageous in its cost and efficiency in the case of relying only on this technique, because of being complicated in the facility and the control.

Then, a covering forging method is proposed (Patent Literature 2) in which a heated member to be forged which is covered with another heat-insulation member is forged together with the heat-insulation member. In addition, in a field of free forging, such a technique is proposed (Patent Literature 3) as to interpose a dummy disk formed from stainless steel as a heat-insulation member between the member to be forged and a lower anvil, because a heat loss particularly from the lower face of the member to be forged is a problem in a closed-die forging method in which the member to be forged always contacts a lower die during forging. These techniques can prevent a temperature decrease in the member to be forged at a low cost with high efficiency. In a column of a conventional technology of Patent Literature 1, such a technology is described as to cover the whole of a base material after having been heated with a heat insulating material like a ceramic fiber or a canning material like a stainless steel material, and to forge the base material remaining covered therewith.

CITATION LIST

Patent Literature

Patent Literature 1: JP-A-06-122036
Patent Literature 2: JP-A-05-177289
Patent Literature 3: JP-A-2000-051987

SUMMARY OF INVENTION

Technical Problem

The above described covering forging method is an effective technique for heat insulating of a member to be forged in closed-die forging. However, if the whole of the member to be forged has been covered according to the technique in Patent Literature 2, the surface skin of the member to be forged during forging cannot be monitored from the outside. Accordingly, it becomes difficult to appropriately grasp the temperature of the member to be forged, and the problem remains in the optimal control of the forging temperature. Furthermore, in Patent Literature 2, a sheet formed from a glass fiber or a ceramic fiber is used in the heat-insulation member. Accordingly, the fiber scatters during forging, and deposits on the surfaces of a product and a die after forging. Thus, there is room for improvement in workability.

In addition, in the case of the technique in Patent Literature 3 in which the heat-insulation member formed from stainless steel is interposed only under the lower face of the member to be forged, the heat insulating state of the part from the lower face to the side face of the member to be forged during forging needs to be readjusted. The heat-insulation member in Patent Literature 3 acts as a lower anvil which is not deformed during forging, and surely supports the lower part of the member to be forged. Accordingly, the heat-insulation member in Patent Literature 3 cannot be applied to the closed-die forging. In a field of the closed-die forging of manufacturing a molded article with a near net shape, which has improved mechanical characteristics, it is important to accomplish plastic deformation that causes the cavity end portions of the die to be filled with the member to be forged.

An object of the present invention is to provide a closed-die forging method capable of preventing a temperature decrease in a member to be forged during forging, easy temperature monitoring during forging, and causing the cavity end portions of a die to be filled with the member to be forged. Another object of the present invention is to provide a method of manufacturing a forged article which has a structure having fine crystal grains, by using this closed-die forging method.

Solution to Problem

The present inventors have reconsidered a conventional covering forging method which is adopted in closed-die forging. As a result, the inventors have found that as for the heat insulation of a member to be forged, if a particular surface portion of the member is covered with a heat-insulation member, sufficient heat insulation for forging can be attained and all of the surfaces of the member to be forged do not need to be covered. The heat-insulation member which is deformed together with the member to be forged is made to be formed from a metal that does not scatter from the surface of the member to be forged even during hard hammer forging and can protect the surface. On the other hand, the closed-die forging requires the plastic deformation which causes the cavity end portions of a die to be filled with the member to be forged. Thus, in order to achieve such a plastic deformation, the arrangement and the quality of the material have been important for the metal heat-insulation member, since the metal heat-insulation member constrains the deformation of the member to be forged to no small extent. Through an extensive research based on the above described findings, the inventors have arrived at a closed-die forging method of the present invention, which can accomplish the above described heat insulation and temperature control during closed-die forging and plastic deformation which causes the cavity end portions of a die to be filled with the member to be forged, and a method of manufacturing a forged article by using the closed-die forging method.

Specifically, the present invention provides a closed-die forging method, which includes placing a heated member to be forged on a lower die and hammer-forging the member to be forged with a reciprocating upper die, wherein the method further includes covering the whole of a portion of the member to be forged that contacts the lower die with a metal heat-insulation member prior to forging, except for at least a part of a portion that contacts an upper die during forging, and then forging the member to be forged integrally with the metal heat-insulation member. The present invention provides a closed-die forging method which preferably includes covering the whole of a portion of the member to be forged, which contacts the lower die, with a metal heat-insulation member prior to forging, except for the central part of a portion which contacts an upper die during forging. Preferably, in the present invention, the member to be forged is a superalloy and the metal heat-insulation member is stainless steel. Further preferably, the member to be forged is forged into a disk shape.

Furthermore, the present invention provides a method of manufacturing a forged article, which includes heat-treating the forged base material obtained by the closed-die forging method described in any one of the above descriptions at temperatures not lower than recrystallization temperature. The method of manufacturing the forged article specifically includes that the member to be forged is a superalloy and the heat treatment is solution treatment.

Advantageous Effects of Invention

The closed-die forging according to the present invention is capable of preventing a surface crack originating in temperature decrease during forging, and is capable of easy temperature control, even though it is the closed-die forging for a hard-to-work material such as a superalloy material. The closed-die forging according to the present invention also accomplishes the plastic deformation which causes the cavity end portions of the die to be filled with the member to be forged. Furthermore, in the structure of the forged article which has been heat-treated after forging, crystal gains are fine, and accordingly a product after forging also has excellent mechanical characteristics. Accordingly, the closed-die forging becomes an essential technology for commercially manufacturing a high-strength component having a near net shape, which is represented by an airplane component such as a turbine disk and a blade.

DESCRIPTION OF EMBODIMENTS

Figure 1:
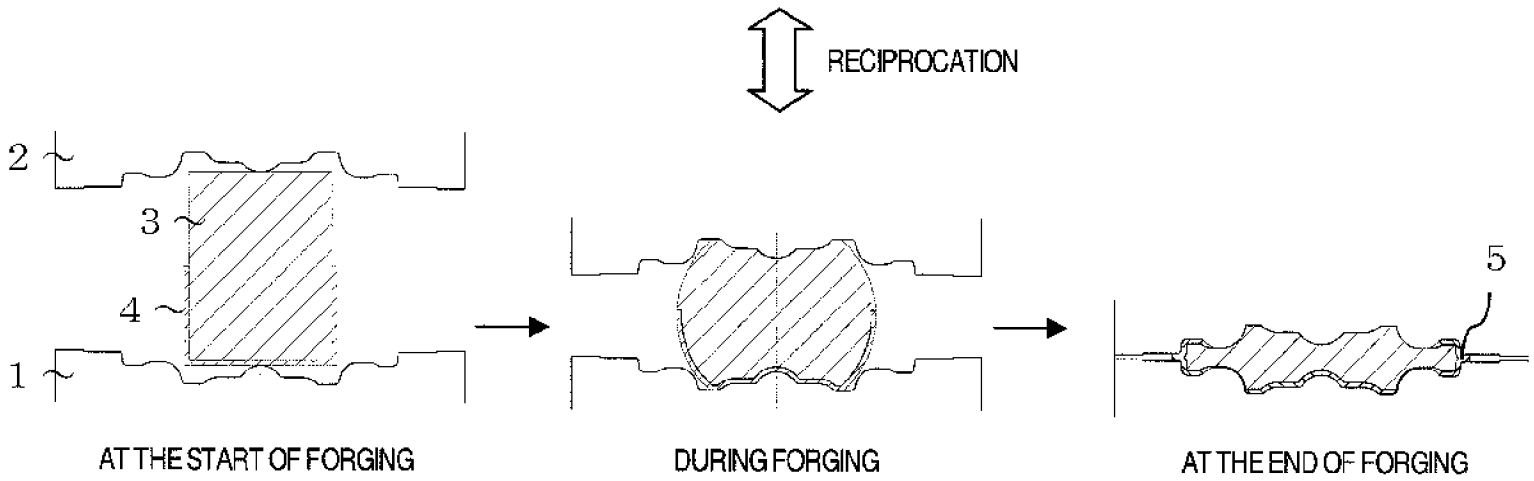
FIG. 1 is a sectional view for describing closed-die forging steps of manufacturing a forged base material having a disk shape, and illustrates one example of the closed-die forging method of the present invention.
Figure 2:
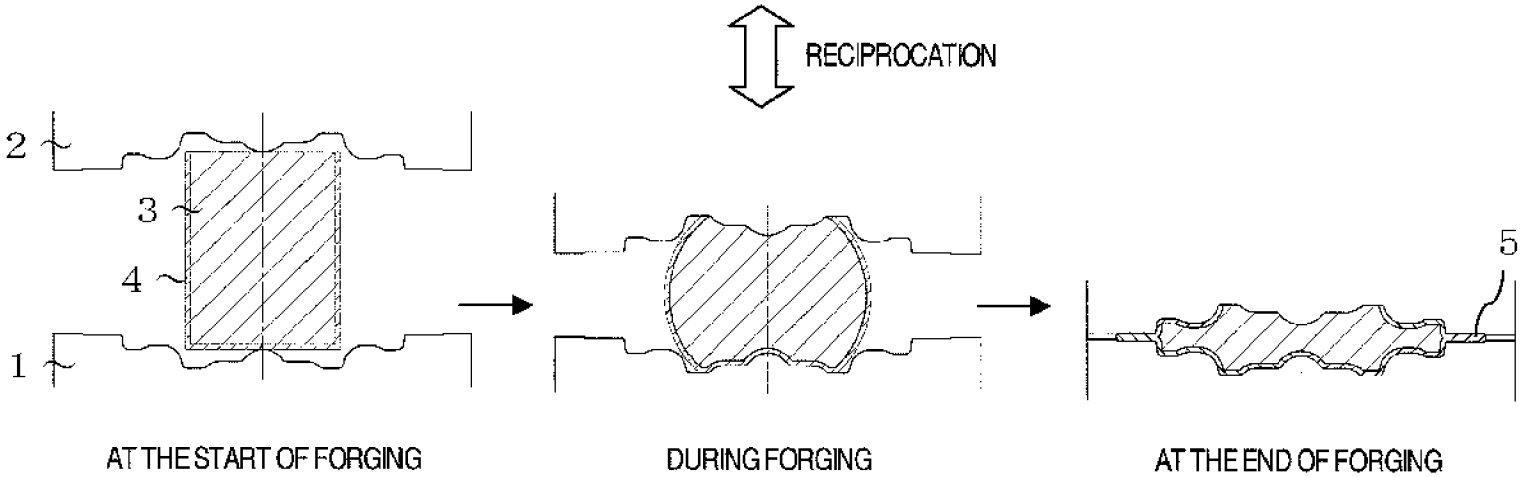
FIG. 2 is a sectional view for describing the closed-die forging steps of manufacturing the forged base material having the disk shape, and illustrates one example of the closed-die forging method of the present invention.

The feature of the present invention resides in that a covering forging method which enables heat insulation of a member to be forged during forging is utilized, and a part of a heat-insulation member is appropriately omitted, and thereby the above described heat insulation and a temperature control through an exposed portion of the member to be forged have been simultaneously achieved. The feature of the present invention also resides in that the plastic deformation has been achieved which causes the cavity end portions of the die to be filled with the member to be forged, preferably by the adjustment of the arrangement of the heat-insulation member (in other words, a portion at which the above described heat-insulation member has been omitted) with respect to all of the surfaces of the member to be forged. The feature of the present invention also resides in that the forged base material obtained by these covering forging methods can be formed into a forged article which has a structure having fine crystal grains and excellent mechanical characteristics, after ordinary heat treatment for imparting the mechanical characteristics, which is conducted subsequently to the forging process. Constituent elements of the present invention will be described below with reference to each one example of the closed-die forging method for manufacturing the forged base material having the disk shape of the present invention, which is illustrated in FIGS. 1 and 2.

(1) The present invention provides a closed-die forging method which includes placing a heated member to be forged on a lower die and hammer-forging the member to be forged with a reciprocating upper die.

In closed-die forging in which the member to be forged always contacts a lower die during forging, there has been a problem that a temperature in a lower part of the member to be forged, which is a contact region with the lower die, is decreased and a local crack occurs in the portion. In the closed-die forging which exerts an effect on the near net shape molding of heat resistance stainless steel such as JIS-SUH660 and a hard-to-work material such as a superalloy which will be described later, it is certainly important to accomplish temperature control during forging and further plastic deformation which causes the cavity end portions of the die to be filled with the member to be forged. Then, the present invention for solving these problems limits its technical field to closed-die forging with a hammer impact.

(2) Prior to forging, the whole of a portion of the member to be forged that contacts the lower die shall be covered with a metal heat-insulation member, except for at least a part of a portion that contacts an upper die during forging.

It is extremely effective for preventing a crack occurring on the lower face of the member to be forged to reduce a heat loss from the portion which contacts the lower die during forging. Accordingly, in the present invention, the portion which contacts the lower die of the member to be forged is previously covered with a heat-insulation member having a heat insulating action against the lower die, before the closed-die forging is started. This portion which contacts the lower die includes a portion that results in contacting the lower die during forging, even though it does not contact the lower die at the start of forging. In FIGS. 1 and 2, a member to be forged having a columnar shape is closed-die-forged into a disk shape. In this case, the whole of the lower face of the member to be forged 3 prior to forging, which corresponds to a portion which contacts with a lower die 1, and at least a lower part of the side face thereof are covered with a heat-insulation member 4. The heat-insulation member 4 is made to be formed from a metal that has the quality of the material which can be plastically deformed while following the shape of the member to be forged during forging, and on the other hand, which is not easily separated and destroyed during forging.

Here, the heat loss from the member to be forged during forging occurs to no small extent even in another portion than the above described portion which contacts the lower die. Accordingly, if only the heat loss during forging has been desired to be prevented, all of the surfaces of the member to be forged prior to forging may be covered with the heat-insulation member according to a conventional method. However, if all of the surfaces of the member to be forged have been covered with the heat-insulation member, the surface of the member to be forged during forging cannot be directly monitored, and it becomes difficult to appropriately control the temperature. In addition, if all of the surfaces of the member to be forged have already been covered in the step of heating the member to be forged to the forging temperature, the temperature of the surface cannot be directly measured prior to forging. If the heating temperature of the member to be forged should be controlled by a heating period of time, for instance, such a work becomes necessary as to grasp the heating periods of time, which vary depending on each forging condition, from a preliminary experiment. Then, the closed-die forging method of the present invention includes exposing a part of the member to be forged, thereby enables the monitoring of the surface in a heating step prior to forging, and during forging, and enables easy temperature control. The portion exposed at this time can be at least a part of the portion which contacts with the upper die during forging. In the cases of FIGS. 1 and 2, at least the upper face of the member to be forged 3 prior to forging, which corresponds to at least a part of the portion that contacts the upper die 2, is not covered with the heat-insulation member 4 and is exposed. When measuring the temperature of the member to be forged during forging, it is easy to use, for instance, a radiation thermometer which can measure the temperature in a fast and non-contact manner. In this case, a range of the above described exposed portion is enough, if it has an area enough for visual monitoring.

The forging temperature should be controlled on the basis of a temperature of the portion which contacts the upper die of the member to be forged. This portion contacts the upper die, which causes the heat loss through the forging period, in a short period of time, and in the other period of time than the contact period of time, it contacts only the air which has high insulating characteristics. Accordingly, the heat loss is comparatively small even when the portion is exposed, and a remarkable crack is unlikely to occur. Accordingly, prior to forging, at least a part of the portion of the member to be forged, which contacts the upper die during forging, is not covered with the heat-insulation member and is exposed. Since at least a part of the portion which contacts the upper die can be thus exposed, the thickness corresponding to the heat-insulation member can be removed in a part or all of portions of a die profile surface when manufacturing the upper die, which enables the cavity for a near net shape closer to the shape of a final product to be designed. However, when the whole region of the portion which contacts the upper die is exposed, it promotes the heat loss to no small extent after all, and accordingly such a minimal portion is desirably exposed as to enable temperature monitoring. The temperature can be monitored and controlled when the upper die is separated from the member to be forged.

(3) In the above item (2), the whole of the portion of the member to be forged that contacts the lower die is preferably covered with the metal heat-insulation member prior to forging, except for a central part of the portion that contacts the upper die during forging.

In the practice of the above item (2), in the present invention, the whole of the portion which contacts the upper die during forging may be exposed. However, in order to reduce the exposed region of this portion to the minimum extent, it is desirable to expose the central part of the portion during forging, and cover a remaining portion except for the central part with the heat-insulation member. The forging temperature can be controlled by the exposure of the central part of the portion which contacts the upper die. In the cases of FIGS. 1 and 2, the portion except for the above described central part out of the portion which contacts the upper die corresponds to the upper part of the side face of the member to be forged 3, which does not contact the upper die 2 before the forging is started. In FIG. 1 in which this upper part of the side face is not covered with the heat-insulation member 4, the plastic deformability of the upper part is different from that of the lower part which is covered with the heat-insulation member 4, to no small extent. If this difference between the deformabilities has been remarkable, material flows which are unequal in the upper and lower parts of the member to be forged occur on the boundary between the upper part and the lower part of the side face, when forging has been started.

Then, in the present invention, the whole of the portion of the member to be forged, which contacts the lower die, is preferably covered with the metal heat-insulation member prior to forging, except for the central part of the portion that contacts the upper die during forging. The surface of the member to be forged 3 in FIG. 2 is covered with the heat-insulation member 4, except for the central part of the portion that contacts the upper die during forging. Thereby, the heat-insulation member 4 which has covered the whole region of the side face of the member to be forged 3 can cover the surface of the forged base material across the upper and lower dies also after the forging has been finished, and it can be accomplished that the cavity of the die is filled with the base material. In addition, a space in which a flash 5 is formed is provided in the outside of the cavity of the die formed of the lower die 1 and the upper die 2 in FIGS. 1 and 2, which causes the inside of the cavity to be filled with the member to be forged 3. During forging, the heat-insulation member 4 which covers the member to be forged 3 exclusively enters the space. After the heat-insulation member 4 has entered the space, a gap between the upper and lower dies is sealed, thereby there is no place for the member to be forged to escape to the outside of the cavity, and the above described filling operation can progress more completely. The height of the space (in other words, width of gap) is preferably set at 5 mm or less. The height is more preferably set at 4 mm or less.

(4) The member to be forged and the metal heat-insulation member shall be forged integrally with each other.

In the closed-die forging, the cavity of the die must be filled with the member to be forged. Because of this, it is inefficient in the die design and also in the workability to separate a behavior of the metal heat-insulation member during forging from that of the member to be forged. Then, in the closed-die forging method of the present invention, the member to be forged and the metal heat-insulation member shall be forged integrally with each other. In addition, the closed-die forging in which the heat-insulation member during forging is not easily separated in an early stage, and preferably is not separated until forging is finished can be accomplished by a die design and the like. The thickness of the heat-insulation member is preferably set at 2 mm or more, from the viewpoint of preventing the above described separation as well as keeping a sufficient heat insulation effect of the member to be forged. However, if the heat-insulation member is excessively thick, an effect of near net shape molding due to the closed-die forging is reduced, and heating prior to forging also takes a long period of time. Accordingly, the thickness is preferably set at 10 mm or less.

(5) Preferably, the member to be forged is a superalloy and the metal heat-insulation member is stainless steel.

The closed-die forging method of the present invention is a technique useful for manufacturing a structural component which is required to have a high-temperature strength, in a form of a near net shape, and is preferably used for manufacturing a component formed from a superalloy material, for instance. Then, when the superalloy is formed into the member to be forged, the heat-insulation member which covers the member to be forged is preferably the stainless steel. The superalloy is an ordinarily known high-temperature strength alloy such as a titanium alloy, an improved alloy thereof and the like, in addition to an iron-based alloy, a nickel-based alloy and a cobalt-based alloy. The stainless steel is the SUS steel which has an enhanced corrosion resistance by the addition of approximately 10 mass % or more chromium and is specified in JIS, or an improved steel thereof.

A deformation resistance of the stainless steel at a high temperature is lower than that of the superalloy. Because of this, during forging, the heat-insulation member formed from the stainless steel having a low deformation resistance does not constrain the deformation of the member to be forged formed from the superalloy, and accordingly the member to be forged can be forged into a required near net shape without trouble. In addition, a coefficient of thermal expansion of the stainless steel is higher than that of the superalloy, accordingly an appropriate gap is produced between the member to be forged and the heat-insulation member during forging, and the produced gap forms an air layer to enhance the heat insulation characteristics. Austenitic stainless steel among the stainless steels is excellent in high-temperature oxidation resistance and is hard to form an oxidized scale, which is more preferable.

(6) Preferably, the member to be forged is forged into a disk shape.

The closed-die forging method of the present invention is a technique useful for manufacturing a structural component which is required to have a high-temperature strength, in a form of a near net shape, and is preferably used for manufacturing a turbine disk of an airplane and a generator, for instance. Then, in order to manufacture the above described turbine disk and the like, it is preferable to obtain a forged base material having a near net shape of the disk shape, which becomes the basis of the turbine disk. This forged base material having the disk shape is forged and molded by the upper die 2 and the lower die 1, while the boundary is ordinarily the center in its thickness direction, as is illustrated in FIGS. 1 and 2. During forging, a large area contacts the lower die 1, and accordingly an effect of preventing a heat loss of the present invention is remarkably exerted.

(7) The method of manufacturing a forged article includes heat-treating a forged base material obtained by the above described closed-die forging method, at temperatures not lower than recrystallization temperature.

The base material which has been closed-die-forged has a structure having finer crystal grains than that of a cast base material, due to recrystallization during forging. After the forging step, the forged base material is usually subjected to heat treatment for imparting necessary mechanical characteristics to a final product. Specifically, the heat treatment is quenching or solution treatment, and the heat treatment is combined with tempering or aging heat treatment. Such a heat treatment is carried out to adjust the structure to an optimal fine structure. In addition, before and/or after a series of these heat treatment steps, the forged base material is machined and is adjusted so as to have a shape of a final product.

In the case of the forged base material obtained according to the present invention, in a portion which has not been covered with the heat-insulation member, the temperature decrease during forging may have preceded to no small extent, recrystallization may not have sufficiently progressed there, and the crystal grains may become slightly rough. However, when the forged base material is heated to not lower than the recrystallization temperature again, the recrystallization progresses and the crystal grains can be controlled to be fine. In the forging method, the portion which contacts the lower die during forging is thermally insulated, thereby a large difference (gradient) of temperature among each of the portions during forging does not occur. Accordingly, the sizes of the above described crystal grains after heating can be almost equalized over the whole region of the base material, and excellent mechanical characteristics are attained. Such a heat treatment can serve as the above described heat treatment which is usually conducted for the forged base material after forging. If the member to be forged is an austenitic metal material or the above described superalloy, for instance, the heat treatment is a solution treatment. If the member to be forged is a martensitic metal material, the heat treatment is quenching. The forged base material can be adjusted so as to have the optimum product structure by being subjected to the aging heat treatment or the tempering after the heat treatment. In addition, before and/or after a series of these heat treatment steps, the forged base material may be machined, as described above.

Example 1

A forged base material having a disk shape was produced by closed-die forging. Firstly, a superalloy (by mass %, 0.05% C, 19.5% Cr, 4.25% Mo, 13.5% Co, 1.3% Al, 3.0% Ti and the balance being Ni) which had a columnar shape with a diameter of 150 mm and a height of 162 mm was prepared for a member to be forged. SUS304 stainless steel was used for a heat-insulation member which covered the member to be forged. The heat-insulation member having two types of cup shapes were prepared which were pipes with an inner diameter that was slightly more enlarged than 150 mm, lengths of between 162 mm and 81 mm, and a thickness of 5 mm, and had a disk with a thickness of 5 mm welded on each of the bottom parts.

Next, the above described members to be forged were stored in the metal heat-insulation members having the respective cup shapes (Example 1 of the present invention). The member to be forged in thus covered state was inserted into a heating furnace, and the temperature was raised to 1,050° C. which was a forging temperature. After the temperature was raised, the temperature on the upper face of the member to be forged which had not been covered with the heat-insulation member was measured with a radiation thermometer, and it was confirmed that the temperature of the member to be forged reached the forging temperature. The temperature of the member to be forged was maintained for a fixed period of time from the time when the temperature was monitored, and then the member to be forged was taken out from the heating furnace.

The taken out member to be forged was placed on the lower die which had been set on a 12.5 ton air drop hammer. Then, the closed-die forging was carried out by hammer-forging the placed member to be forged with a reciprocating upper die according to each aspect of FIGS. 1 and 2, and a forged base material having a disk shape was produced (where the height of the space in which the flash 5 was formed was set at 3 mm). At this time, a first hit should press the placed member to be forged in such a degree as to slightly push the placed member to be forged with a hammer so as to align the core (centering) of the member to be forged with respect to the cavity of the die, but in the aspect of FIG. 2, the upper part of the member to be forged after the first hit became a state of slightly projecting from the upper edge of the cup of the heat-insulation member. After the second hit, as the pressing of the member to be forged progressed, the middle part of the member to be forged projected and was deformed into a barrel shape, and the heat-insulation member was also deformed so as to follow the shape of the member to be forged. The temperature of the member to be forged during forging was monitored on a portion which existed in such a range as to be hit by the upper die and was not covered with the heat-insulation member. At the end of forging, the heat-insulation member which was softer than the member to be forged did not exfoliate, a part of the heat-insulation member was released to the outside of the cavity as the flash, and the inside of the cavity between the upper die and the lower die was filled with the member to be forged. Then, the heat-insulation member was removed, and a forged base material having a disk shape of the near net shape could be produced.

On the other hand, a member to be forged in an original state of not being covered with the heat-insulation member was also prepared (Comparative Example 1). The member to be forged was heated in a similar way to the above, and was forged according to each of the aspects of FIGS. 1 and 2. The temperature of the member to be forged during forging was monitored on a portion which was being hit by the upper die. At the end of forging, only a part of the member to be forged was released to the outside of the cavity as the flash, and the inside of the cavity between the upper die and the lower die was filled with the member to be forged. A forged base material having a disk shape of the near net shape was produced by the above described operation.

The above described forged base materials which were produced according to the aspects of FIGS. 1 and 2 were subjected to a visible dye penetrant inspection, and the presence or absence of the occurrence of a surface crack was checked. As a result, in Example 1 of the present invention, the surface crack was not found in a portion which was covered with the heat-insulation member and included the portion that contacted the lower die during forging. The surface crack was not found also in the portion which was not covered with the heat-insulation member, in other words, in a part of the portion that contacted the upper die during forging, and an adequate surface skin could be attained. On the other hand, in Comparative Example 1 which did not use the heat-insulation member, the surface crack occurred in the portion which contacted the lower die during forging.

Figure 3:
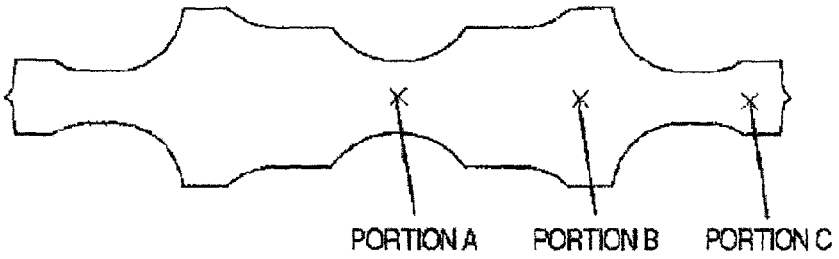
FIG. 3 is a sectional view of the forged base material having the disk shape obtained in FIGS. 1 and 2, and illustrates positions of a structure observed in Examples 1 to 3.

Furthermore, the above described forged base materials were subjected to a solution treatment of heating the forged base material to approximately 1,025° C., keeping the heated forged base materials for 4 hours and oil-cooling the resultant forged base materials. Then, the sizes of the crystal grains in the structures after the heat treatment were evaluated. The portions at which the structures were observed were three portions A, B and C in a longitudinal cross-section of the disk shape illustrated in FIG. 3, and were half positions toward the center from the surface, respectively. The sizes of the crystal grains were evaluated on the basis of a crystal grain size number according to ASTM E112 (the larger the number is, the finer the size is). The results are shown in Table 1 and FIG. 4.

TABLE 1

| | Crystal grain size number | | |
|---|---|---|---|
| Observed position | Portion A | Portion B | Portion C |
| Example 1 of the present invention (with cover) | 6.5 | 6.5 | 6.5 |
| Comparative Example 1 (without cover) | 6.5 | 4.5 | 7.5 |

Figure 4:
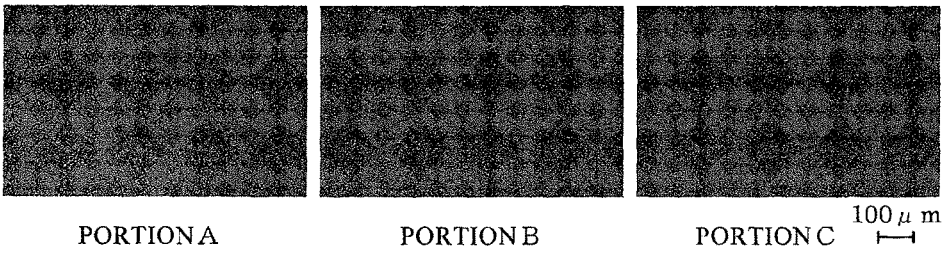
FIG. 4 is a photograph of a structure of a forged article manufactured in Example 1, and illustrates one example of an effect of the present invention.
Figure 4:
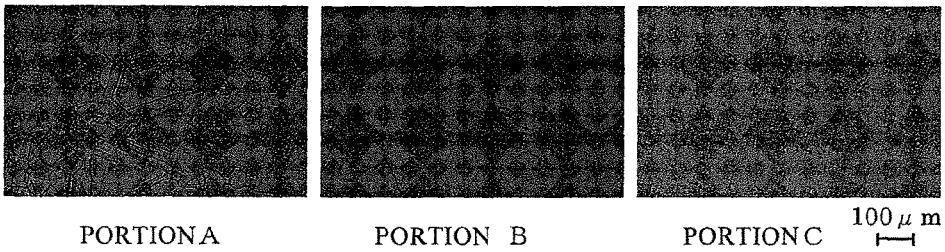

According to Table 1 and FIG. 4, the crystal grain sizes of the forged article in Example 1 of the present invention were fine and uniform in the all portions after the solution treatment. On the other hand, in the forged article in Comparative Example 1 which did not use the heat-insulation member, crystal grains were larger in a part of the forged article than those in the example of the present invention, and crystal grain sizes were ununiform from the central part to the outer peripheral part, due to a large temperature gradient generated in the member to be forged during forging.

Example 2

A forged base material having a disk shape of Example 2 (with cover) of the present invention was produced according to forging conditions of Example 1, except that a superalloy (by mass %, 0.03% C, 19% Cr, 53% Ni, 3% Mo, 0.5% Al, 0.8% Ti, and the balance being Fe) was used for a member to be forged, and that a forging temperature was set at 980° C. As a result, as for the forged base material of Example 2 of the present invention, the temperature of the member during forging was kept to be high and uniform, the local decrease of plastic deformability was prevented, and the inside of the cavity between the upper die and the lower die was sufficiently filled with the member to be forged. The surface crack was not found in the forged base material of Example 2 of the present invention.

Figure 5:
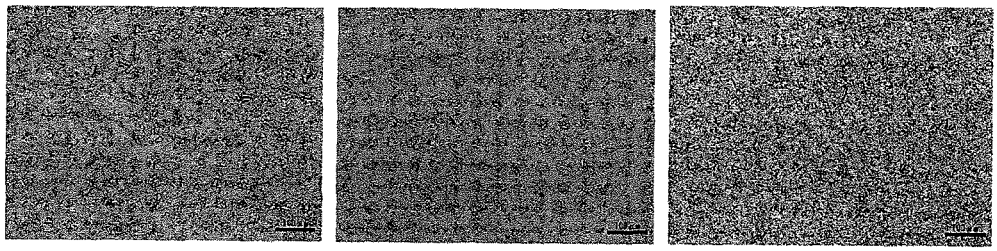
FIG. 5 is a photograph of a structure of a forged base material manufactured in Example 2, and illustrates one example of the effect of the present invention.

In addition, the sizes of crystal grains in the structure in a state prior to this heat treatment were evaluated. The evaluation procedure is the same as that in Example 1. The results are shown in Table 2 and FIG. 5. In the forged base material in Example 2 of the present invention, the crystal grain sizes were fine in the all portions, and the uniformity was also adequate.

TABLE 2

| | Crystal grain size number | | |
|---|---|---|---|
| Observed position | Portion A | Portion B | Portion C |
| Example 2 of the present invention (with cover) | 10 | 10 | 12 |

Example 3

A forged base material having a disk shape of Example 3 (with cover) of the present invention was produced according to forging conditions of Example 1, except that a titanium alloy (by mass %, 6% Al, 4% V and the balance being Ti) was used for a member to be forged, and that a forging temperature was set at 950° C. As a result, as for the forged base material of Example 3 of the present invention, the inside of the cavity between the upper die and the lower die was filled with the member to be forged. The surface crack was not found in the forged base material of Example 3 of the present invention.

Figure 6:
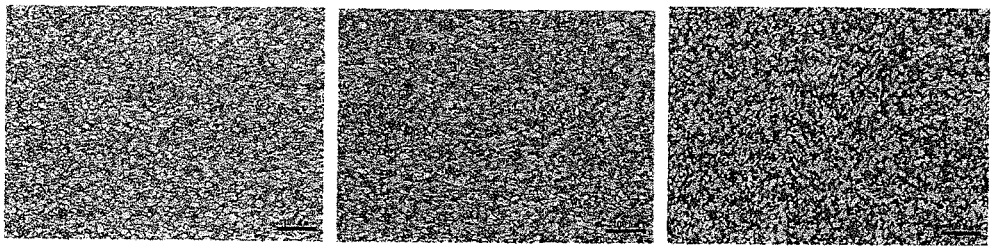
FIG. 6 is a photograph of a structure of a forged base material manufactured in Example 3, and illustrates one example of the effect of the present invention.

In addition, the sizes of crystal grains in the structure in a state prior to this heat treatment were evaluated. The portions at which the structures were observed were three portions A, B and C illustrated in FIG. 3, which were the same as in Example 1. The result is shown in FIG. 6. The forged base material in Example 3 of the present invention had fine crystal grains by a crystal grain size number of around 10 in the all portions, and also had an adequate uniformity of the crystal grains.

INDUSTRIAL APPLICABILITY

The present invention can be preferably applied to a method for obtaining a forged base material having a disk shape of a near net shape, and can be applied also to manufacturing of a closed-die-forged base material of which the shape is asymmetric between upper and lower sides and/or between right and left sides. In addition, the present invention can be applied to manufacturing of a forged product which is obtained by heat-treating and machining the base materials.

REFERENCE SIGNS LIST

1 Lower die
2 Upper die
3 Member to be forged
4 Heat-insulation member
5 Flash

The invention claimed is:

1. A closed-die forging method, comprising:

covering a first surface of a member to be forged with a metal heat-insulation member, wherein the member to be forged has a columnar shape and has a planar lower face a side face, and an upper surface, wherein the first surface comprises the planar lower face and the whole side face of the member to be forged, such that a second surface of the member to be forged, which is at least part of a central top of the upper surface of the member to be forged, is not covered with the metal heat-insulation member;

heating the member to be forged to provide a heated member to be forged;

placing the heated member to be forged on a lower die, such that the planar lower face of the first surface is in contact with the lower die; and hammer-forging the member to be forged with a reciprocating upper die, such that the second surface is in contact with the reciprocating upper die during the hammer-forging and such that the member to be forged is forged integrally with the metal heat-insulation member wherein the lower die and the upper die form a cavity, and a space is provided outside of the cavity, the metal heat-insulation member exclusively entering the space during the hammer-forging.

2. The closed-die forging method according to claim 1, wherein the second surface is a central part of the upper surface of the member to be forged that contacts the upper die during the hammer-forging.

3. The closed-die forging method according to claim 1, wherein the member to be forged is a superalloy and the metal heat-insulation member is stainless steel.

4. The closed-die forging method according to claim 1, wherein the member to be forged is forged into a disk shape.

5. A method of manufacturing a forged article, comprising heat-treating a forged base material obtained by the closed-die forging method according to claim 1, at temperatures not lower than a recrystallization temperature of the forged base material.

6. The method of manufacturing the forged article according to claim 5, wherein the member to be forged is a superalloy and the heat treatment is solution treatment.

7. The method of manufacturing the forged article according to claim 5, wherein the second surface is a central part of the upper surface of the member to be forged that contacts the upper die during the hammer-forging.

8. The method of manufacturing the forged article according to claim 5, wherein the member to be forged is a superalloy and the metal heat-insulation member is stainless steel.

9. The method of manufacturing the forged article according to claim 5, wherein the member to be forged is forged into a disk shape.

10. The closed-die forging method according to claim 1, wherein a height of the space is 5 mm or less.

11. The closed-die forging method according to claim 1, wherein a thickness of the metal heat-insulation member is 2-10 mm.

* * * * *